US011495380B2

(12) United States Patent
Mecklenburg

(10) Patent No.: US 11,495,380 B2
(45) Date of Patent: Nov. 8, 2022

(54) BISTABLE HOISTING SOLENOID

(71) Applicant: RHEFOR GBR, Berlin (DE)

(72) Inventor: Arno Mecklenburg, Berlin (DE)

(73) Assignee: RHEFOR GBR, Berlin (DE)

( * ) Notice: Subject to any disclaimer, the term of this patent is extended or adjusted under 35 U.S.C. 154(b) by 664 days.

(21) Appl. No.: 16/482,695

(22) PCT Filed: Jan. 31, 2018

(86) PCT No.: PCT/EP2018/052439
§ 371 (c)(1),
(2) Date: Jun. 12, 2020

(87) PCT Pub. No.: WO2018/141815
PCT Pub. Date: Aug. 9, 2018

(65) Prior Publication Data

US 2020/0312509 A1 Oct. 1, 2020

(30) Foreign Application Priority Data

Feb. 1, 2017 (DE) ..... 102017000901.5

(51) Int. Cl.
*H01F 7/16* (2006.01)
*H01F 7/08* (2006.01)
*H01F 27/28* (2006.01)

(52) U.S. Cl.
CPC ..... *H01F 7/1607* (2013.01); *H01F 7/081* (2013.01); *H01F 27/28* (2013.01)

(58) Field of Classification Search
None
See application file for complete search history.

(56) References Cited

U.S. PATENT DOCUMENTS 2,579,723 A * 12/1951 Best ..... H01F 7/1615 251/129.1
3,460,081 A * 8/1969 Alfred ..... H01F 7/1615 335/268

(Continued)

FOREIGN PATENT DOCUMENTS

DE 2614004 A1 10/1976
DE 3702680 A1 10/1987

(Continued)

OTHER PUBLICATIONS

ISA European Patent Office, International Search Report Issued in Application No. PCT/EP2018/052439, dated Jul. 12, 2018, WIPO, 8 pages.

*Primary Examiner* — Matthew W Jellett
(74) *Attorney, Agent, or Firm* — McCoy Russell LLP

(57) ABSTRACT

A bistable hoisting solenoid comprising first and second stroke end position and a stroke center position, comprising: a stator, one or more armatures, at least one coil, at least one permanent magnet and a spring system having a first spring which, in the first stroke end position, exerts a force in the direction of the stroke center position on the one or more armatures, and a second spring which, in the second stroke end position, exerts a force in the direction of the stroke center position on the one or more armatures. The one or more armatures, in the event of a loss of current, are held by permanent magnets in both stroke end positions. The first and the second springs have different paths with different lengths and/or exert in the respective stroke end position different sized forces on the one or more armatures and/or have different sized spring rates.

20 Claims, 4 Drawing Sheets

(56) References Cited

U.S. PATENT DOCUMENTS

| | | | | |
|---|---|---|---|---|
| 4,310,143 | A * | 1/1982 | Determan | H01F 7/064 251/129.08 |
| 4,829,947 | A | 5/1989 | Lequesne | |
| 5,787,915 | A * | 8/1998 | Byers | F16K 31/0613 318/653 |
| 6,677,844 | B1 * | 1/2004 | Gorospe | H01F 7/16 70/277 |
| 6,791,442 | B1 * | 9/2004 | Schmidt | H01F 7/1615 335/266 |
| 9,478,338 | B2 * | 10/2016 | Chen | H01F 7/1615 |
| 2004/0113731 | A1 | 6/2004 | Moyer et al. | |
| 2006/0231050 | A1 | 10/2006 | Lewis et al. | |
| 2013/0201590 | A1 | 8/2013 | Pantke | |

FOREIGN PATENT DOCUMENTS

| | | | |
|---|---|---|---|
| DE | 19607773 | A1 | 9/1997 |
| DE | 102007016039 | A1 | 10/2008 |
| DE | 102007055578 | A1 | 11/2008 |
| DE | 102008001044 | A1 | 10/2009 |
| DE | 102010041086 | A1 | 3/2012 |
| DE | 102014117702 | A1 | 6/2016 |
| EP | 1975960 | A1 | 10/2008 |
| EP | 2822004 | B1 | 2/2016 |
| WO | 2008119785 | A1 | 10/2008 |
| WO | 2014023326 | A1 | 2/2014 |
| WO | 2015058742 | A2 | 4/2015 |

* cited by examiner

BISTABLE HOISTING SOLENOID

CROSS-REFERENCE TO RELATED APPLICATIONS

The present application is a U.S. National Phase of International Patent Application Serial No. PCT/EP2018/052439 entitled "BISTABLE HOISTING SOLENOID," filed on Jan. 31, 2018. International Patent Application Serial No. PCT/EP2018/052439 claims priority to German Patent Application No. 10 2017 000 901.5 filed on Feb. 1, 2017. The entire contents of each of the above-referenced applications are hereby incorporated by reference for all purposes.

TECHNICAL FIELD

The present invention relates to a bistable lifting solenoid that has a first and a second end of stroke position.

BACKGROUND AND SUMMARY

A bistable lifting solenoid is known from WO 2015/058742 A2 that a stator, one or more armatures, at least one coil, at least one permanent magnet, and a spring system having a first spring that exerts a force on the armature or armatures in the direction toward an end of stroke position in the first end of stroke position and having a second spring that externs a force on the armature or armatures in the direction toward the center of stroke position in the second end of stroke position, wherein the armature or armatures are held in a permanent magnetic manner against the spring force in both end positions in the currentless case. The spring system permits a particularly efficient operation of the lifting solenoid.

Further bistable lifting solenoids having spring systems are known from the documents US 2006/231050 A1 and U.S. Pat. No. 4,829,947 A.

It is the object of the present invention to provide an improved bistable lifting solenoid.

This object is inter alia achieved in a first aspect by a bistable lifting solenoid in accordance with the disclosure.

The present invention comprises lifting solenoids that are respectively bistable independently of one another in accordance with a plurality of aspects described in more detail in the following.

The lifting solenoids each have a first end of stroke position and a second end of stroke position. The lifting solenoids comprise a stator, one or more armatures, at least one coil, and at least one permanent magnet, wherein the armature or armatures are held in a permanent magnetic manner in both end of stroke positions in the currentless case. The lifting solenoids preferably each have a spring system having a first spring that exerts a force on the armature or armatures in the direction toward a center of stroke position in the first end of stroke position and having a second spring that externs a force on the armature or armatures in the direction toward a center of stroke position in the second end of stroke position, wherein the armature or armatures are held in a permanent magnetic manner against the spring force in both end of stroke positions in the currentless case. The lifting solenoids preferably have two coils.

The individual aspects of the present invention will now be shown in more detail. If not otherwise stated, preferred embodiments and possible embodiments each relate to all the independent aspects.

In a first aspect, the present invention comprises a bistable lifting solenoid that has a first end of stroke position and a second end of stroke position. The bistable lifting solenoid comprises a stator, one or more armatures, at least one coil, at least one permanent magnet, and a spring system having a first spring that exerts a force on the armature or armatures in the direction toward a center of stroke position in the first end of stroke position and having a second spring that externs a force on the armature or armatures in the direction toward a center of stroke position in the second end of stroke position, wherein the armature or armatures are held in a permanent magnetic manner against the spring force in both end of stroke positions in the currentless case. Provision is made in accordance with the invention in accordance with the first aspect that the first and second springs have spring travels of different lengths and/or exert forces of different strengths on the armature or armatures and/or have spring rates of different amounts in the respective end of stroke position. A variety of design advantages result from the different springs.

For example, the lifting solenoid can be configured such that it is moved with a greater force and/or at a greater acceleration from one of the two end of stroke positions in the direction toward the center of stroke position than from the other end of stroke position. This is of advantage in a number of applications.

The spring travel of the first spring is preferably greater than the spring travel of the second spring and the second spring exerts a greater force on the armature or armatures in the second end of stroke position than the first spring exerts on the armature or armatures in the first end of stroke position.

Alternatively or additionally, the spring travel of the first spring can be greater than the spring travel of the second spring and the spring rate of the second spring in the second end of stroke position can be greater than the spring rate of the first spring in the first end of stroke position.

In a possible embodiment of the present invention, the spring travel of the first spring amounts to between twice and 100 times the spring travel of the second spring, preferably between 4 times and 20 times.

In a further possible embodiment of the present invention, the force the second spring exerts on the armature or armatures in the second end of stroke position amounts to between 1.5 times and 100 times the force the first spring exerts on the armature or armatures in the first end of stroke position, preferably between 3 times and 15 times.

In a further possible embodiment of the present invention, the spring rate of the second spring in the second end of stroke position amounts to between twice and 1000 times the spring rate of the first spring in the first end of stroke position, preferably between 10 times and 500 times, further preferably between 20 times and 100 times.

The two springs can have a spring rate constant over the spring travel or can have a spring rate asymmetrical over the spring travel.

In accordance with a further aspect of the present invention that is preferably combined with the first aspect, at least one of the springs, and preferably the second spring, does not generate any force between the armature and the stator over a part of the stroke distance and/or is not in contact with the armature and/or with the stator over a part of the stroke distance.

A retention security is preferably provided in this case that secures the spring in a predetermined position over this part of the stroke distance and in so doing preferably holds it in a preloaded state.

In a preferred embodiment, the bistable lifting solenoid has an asymmetrical characteristic. The movement from the first end of stroke position into the second end of stroke position in particular differs with the same supply of current to the coil, in particular with respect to the progression of the force and/or speed of the lifting solenoid.

Provision is made in a possible embodiment that the magnetic holding force of the lifting solenoid is smaller in one of the two end of stroke positions than in the other end of stroke position. The magnetic holding force of the lifting solenoid can in particular be at least 20% smaller in one of the two end of stroke positions, further preferably at least 30% smaller than in the other end of stroke position.

The magnetic holding force in the first end of stroke position is preferably smaller than in the second end of stroke position.

Alternatively or additionally, the magnetic holding force in one of the end of stroke positions can amount to at least 20% of the magnetic holding force in the other end of stroke position, preferably at least 30%.

Provision is made in a possible embodiment that the stator and the armature or armatures have a geometrical characteristic influence in one of the end of stroke positions, and preferably in the first end of stroke position, in particular a working air gap, in particular a conically extending working air gap, not extending in a plane perpendicular to the axle of the lifting solenoid.

The stator and the armature or armatures preferably have a weaker or no geometrical characteristic influence in the other end of stroke position, and preferably in the second end of stroke position.

Provision is made in a possible embodiment that the difference between the amount of the magnetic holding force and the amount of the force that the respective spring applies differs by a maximum of 50% of the larger value in both end of stroke positions.

In accordance with a further aspect of the present invention, the lifting solenoid has a resting point in a position between the two end of stroke positions in the currentless case. It is here a third stroke position of the lifting solenoid that is stable in the currentless case. This aspect is preferably combined with the first aspect.

Provision is made in a possible embodiment that the resting point is offset with respect to the center of the travel distance, with the resting point preferably being arranged between one of the end of stroke positions, in particular the second end of stroke position, and the center of the stroke distance.

The distance between the resting point and the center of the stroke distance preferably amounts to more than 5% of the stroke distance, further preferably more than 10%, further preferably more than 20%.

Alternatively or additionally, the distance between the resting point and the one end of stroke position from which it has the smaller distance, in particular from the second end of stroke position, amounts to more than 2% of the stroke distance, further preferably more than 5%, further preferably more than 10%.

In accordance with a further aspect of the present invention, the potential energy, excluding the electrical energy and in the currentless case, stored in the two end of stroke positions of the lifting solenoid, does not differ by more than 50% of the greater value, preferably by no more than 25%. A particularly energy saving operation of the lifting solenoid hereby becomes possible.

Some design features of the lifting solenoid will be described in the following that can be implemented both individually and in combination, and indeed in all of the above-described aspects and in the still following aspects.

Provision is made in a possible embodiment that the at least one coil and the at least one permanent magnet are arranged at the stator.

Provision is made in a possible embodiment that the stator forms a housing that surrounds the armature or armatures, with an armature preferably being provided that is arranged in the interior of the stator on a guide rod, with the guide rod preferably being movably supported at the stator.

Provision is made in a possible embodiment that the spring system is arranged within the stator, with the first spring preferably being arranged between the first front section and a first side of the armature and the second spring being arranged between a second front section and a second side of the armature, and/or with the first and second springs being configured as coil springs that encompass the guide rod of the armature.

Provision is made in a possible embodiment that the stator has a soft magnetic sleeve and first and second soft magnetic front sections that form a housing in which the armature is displaceably arranged.

In a possible embodiment, at least one first working air gap can be provided between the armature and the first front section and at least one second working air gap can be provided between the armature and the second front section.

At least one permanent magnet and at least one first coil and one second coil are preferably arranged at the stator, with the armature forming a first magnetic part circuit with the sleeve and the first front section in the first end of stroke position, said first magnetic part circuit surrounding at least the first coil, while the working air gap or gaps are opened to a maximum with the second front section, and with the armature forming a second magnetic part circuit with the sleeve and the second front section in the second end of stroke position, said second magnetic part circuit surrounding at least the second coil, while the working air gap or gaps are opened to the maximum with the first front section.

Provision is made in a possible embodiment that the at least one permanent magnet is arranged between the first and second coils in an axial direction and forms a respective part of the first and second magnetic part circuits, with the permanent magnet being arranged such that it overlaps the armature both in the first end of stroke position and in the second end of stroke position in the axial direction and preferably surrounds it, with the permanent magnet preferably being directly magnetically coupled to the armature. Different arrangements of the permanent magnet or permanent magnets are, however, also possible.

In a second aspect, the present invention comprises a bistable lifting solenoid that has a first end of stroke position and a second end of stroke position. The lifting solenoid comprises a stator, one or more armatures, at least one coil, and at least one permanent magnet, wherein the armature or armatures are held in a permanent magnetic manner in both end of stroke positions in the currentless case. The stator has a soft magnetic sleeve and a first soft magnetic end section and a second soft magnetic end section that form a housing in which the armature is displaceably arranged, with at least one first working air gap being provided between the armature and the first front section and with at least one second working air gap being provided between the armature and the second front section. At least one permanent magnet and at least one first coil and one second coil are arranged at the stator, with the armature forming a first magnetic part circuit with the sleeve and the first front section in the first end of stroke position, said first magnetic part circuit surrounding at least the first coil, while the working air gap or gaps are opened to a maximum with the second front section, and with the armature forming a second magnetic part circuit with the sleeve and the second front section in the second end of stroke position, said second magnetic part circuit surrounding at least the second coil, while the working air gap or gaps are opened to the maximum with the first front section. The lifting solenoid in accordance with the first aspect is characterized in that at least one first permanent magnet and one second permanent magnet are provided, wherein the first and second coils are arranged between the first and second permanent magnets in the axial direction, with the first permanent magnet putting the sleeve and the first front section under a magnetic voltage and the second permanent magnet putting the sleeve and the second front section under a magnetic voltage.

The construction length can hereby be reduced with respect to other design embodiments.

Provision is made in a possible embodiment that the first magnetic part circuit encompasses the first permanent magnet and the second magnetic part circuit encompasses the second permanent magnet.

Provision is made in a possible embodiment that the armature magnetically short circuits the sleeve and the first front section in the first end of stroke position and that the armature magnetically short circuits the sleeve and the second front section in the second end of stroke position.

Provision is made in a possible embodiment that the sleeve has a magnetic circuit section between the two coils that overlaps the armature in both the first end of stroke position and in the second end of stroke position in the axial direction and that preferably surrounds it, with the magnetic circuit section preferably magnetically directly coupling at the armature.

Provision is made in a possible embodiment that the first and second coils are arranged at least partly between the sleeve and the movement range of the armature and/or in an inner groove and/or cutout of the sleeve.

The lifting solenoid preferably further has a spring system having a first spring that exerts a force on the armature or armatures in the direction toward a center of stroke position in the first end of stroke position and having a second spring that externs a force on the armature or armatures in the direction toward a center of stroke position in the second end of stroke position, wherein the armature or armatures are held in a permanent magnetic manner against the spring force in the first and second end of stroke positions in the currentless case.

Provision is made in accordance with a further aspect of the present invention that is preferably combined with the second aspect that the first and/or second front section(s) has/have a fastening region that extends beyond the first and/or second permanent magnet(s) in the radial direction and is/are fastened to the sleeve. The assembly is hereby substantially simplified.

The fastening region is preferably magnetically saturated by the first or second permanent magnet.

In a possible embodiment, the fastening region is of board-shape, in particular of an annular board shape, and/or has cutouts.

In a possible embodiment, the fastening region has less material toward the outside and in particular becomes thinner.

The above-described aspects of the present invention can be implemented independently of one another. Two or more of the above-described aspects of the present invention are, however, preferably implemented in combination, in particular the first and second aspects in combination.

In a third independent aspect, the present invention comprises a control for a lifting solenoid in accordance with the invention having one or more electrical energy stores, in particular capacitors, and having a control that discharges the energy store or stores via the at least one coil of the lifting solenoid with the aid of switches, in particular semiconductor switches, such that the lifting solenoid is moved from one end of stroke position into the other end of stroke position. High adjustment forces and/or accelerations can hereby nevertheless be achieved with a relatively low current consumption.

Provision is made in a possible embodiment that the control recognizes an interruption and/or a switching off of a voltage supply and moves the lifting solenoid in response thereto, in particular from the first end of stroke position into the second end of stroke position, with the dropping of the supply voltage preferably being recognized by means of a flank recognition. A lifting solenoid equipped with this control can hereby be used instead of a monostable lifting solenoid or of a monostable pneumatic drive.

In a possible embodiment, the control is configured such that in response to a switching on of the supply voltage, the electrical energy store or stores, preferably capacitor(s), is/are charged and such that the reaching of a specific threshold voltage at the electrical store is recognized by the control, whereupon the latter discharges the energy store or stores via the bistable lifting solenoid so that it moves in the opposite direction, in particular into the first end of stroke position.

Provision is made in a possible embodiment that the bistable lifting solenoid is controlled by a full bridge, in particular by a MOSFET full bridge.

In a preferred embodiment, the circuit has two further semiconductor switches via which a first energy store and a second energy store can be connected in parallel in a first switching state and can be separately discharged in a second switching state.

The control can furthermore comprise means for position detection of the stopper, with the control preferably having a microcontroller that is connected to the means for position detection and that takes account of the location information acquired by means of the means for position detection on the control of the bistable lifting solenoid.

In accordance with a further preferred aspect, the control has at least one first energy store and one second energy store, with the first energy store being able to be discharged in series b< two coils of the lifting solenoid, and with the second energy store being able to be discharged by only one of the two coils of the lifting solenoid.

In a possible embodiment, the second energy store is selectively able to be discharged by one of the two coils. The discharge can here in particular take place by the first coil or by the second coil in dependence on the direction of movement.

Alternatively or additionally, the second energy store can selectively also be able to be discharged in series by the two coils of the lifting solenoid. The discharge can here in particular take place by one of the two coils or in series by the two coils in dependence on the direction of movement.

The control is in particular designed such that, for a control of a first direction of movement of the lifting solenoid, in particular of from the first end of stroke position into the second end of stroke position, both energy stores are discharged in series by two coils of the lifting solenoid and, for a control of a second direction of movement of the lifting solenoid, in particular from the second end of stroke position into the first end of stroke position, the first energy store is discharged in series by the two coils and the second energy store is discharged by only one of the two coils, in particular by the first coil.

The discharge of the second energy store particularly preferably takes place with a time lag to the discharge of the first energy store, with the discharge of the second energy store preferably starting even before the occurrence of the adjustment process.

The control described in more detail above in accordance with the third aspect of the present invention is also a subject of the present invention independently of the specific embodiment of the lifting solenoid.

The control is preferably used with a lifting solenoid that has two coils that are connected in series and that preferably have a central tapping.

The control in particular takes place such that both energy stores are discharged by the coils connected in series along a first direction of movement, in particular along a direction of movement from the first end of stroke position into the second end of stroke position, while on the opposite direction of movement, in particular a movement from the second end of stroke position into the first end of stroke position, the first energy store is first discharged by the coils connected in series and the second energy store is discharged with a time delay by the central tapping of both coils, with the discharge of the second energy store preferably starting even before the occurrence of the adjustment process.

The control in accordance with the invention is particularly preferably used in accordance with the third aspect with a lifting solenoid such as was described in more detail above, in particular with a lifting solenoid in accordance with one of the aspects described in more detail above and/or with the preferred design embodiment described in more detail above.

The present invention will now be described in more detail with reference to embodiments and drawings.

BRIEF DESCRIPTION OF THE FIGURES

There are shown.

DETAILED DESCRIPTION

Figure 1:
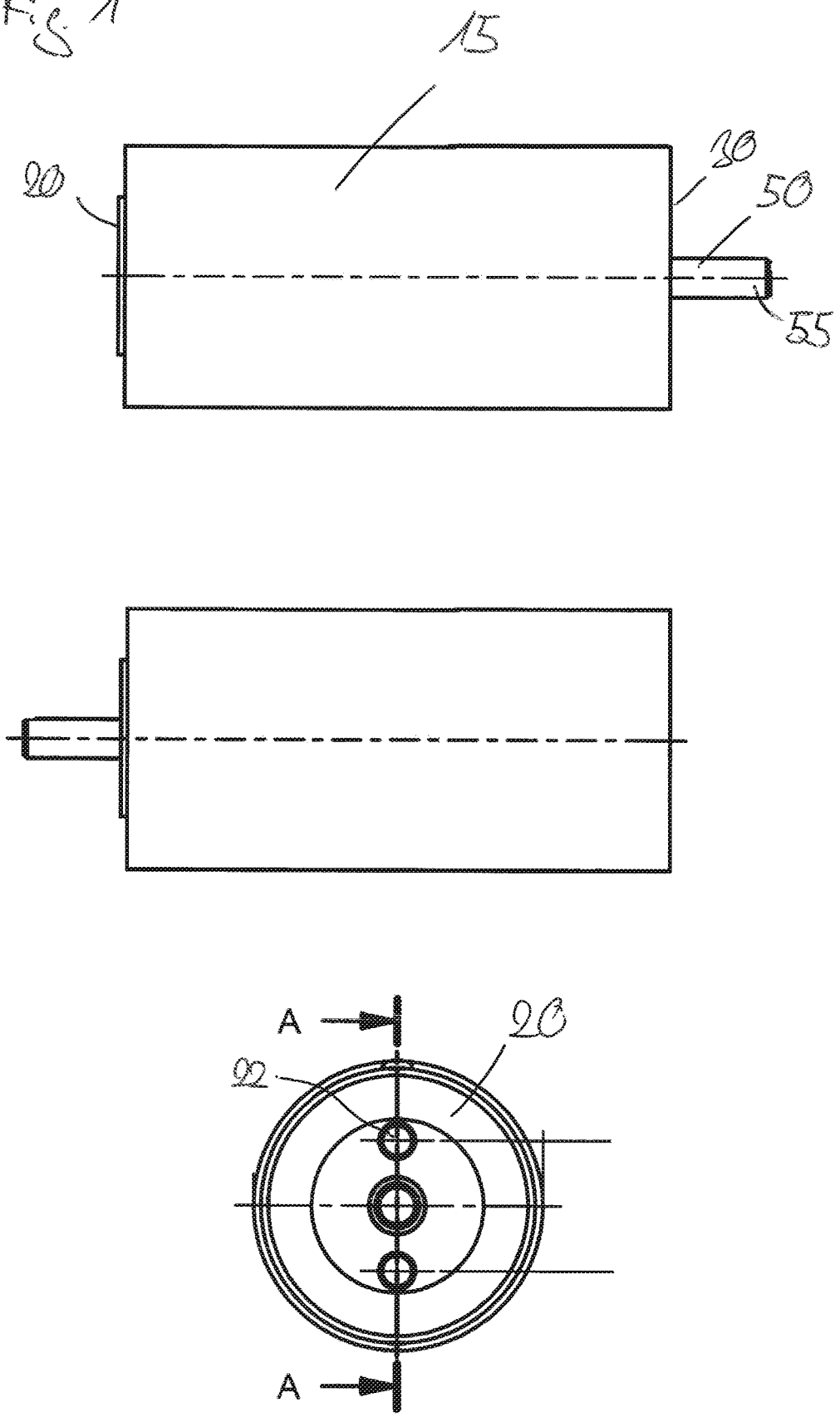
FIG. 1: an embodiment of a bistable lifting solenoid in which a plurality of aspects of the present invention are implemented in combination in three views from the outside.
Figure 2:
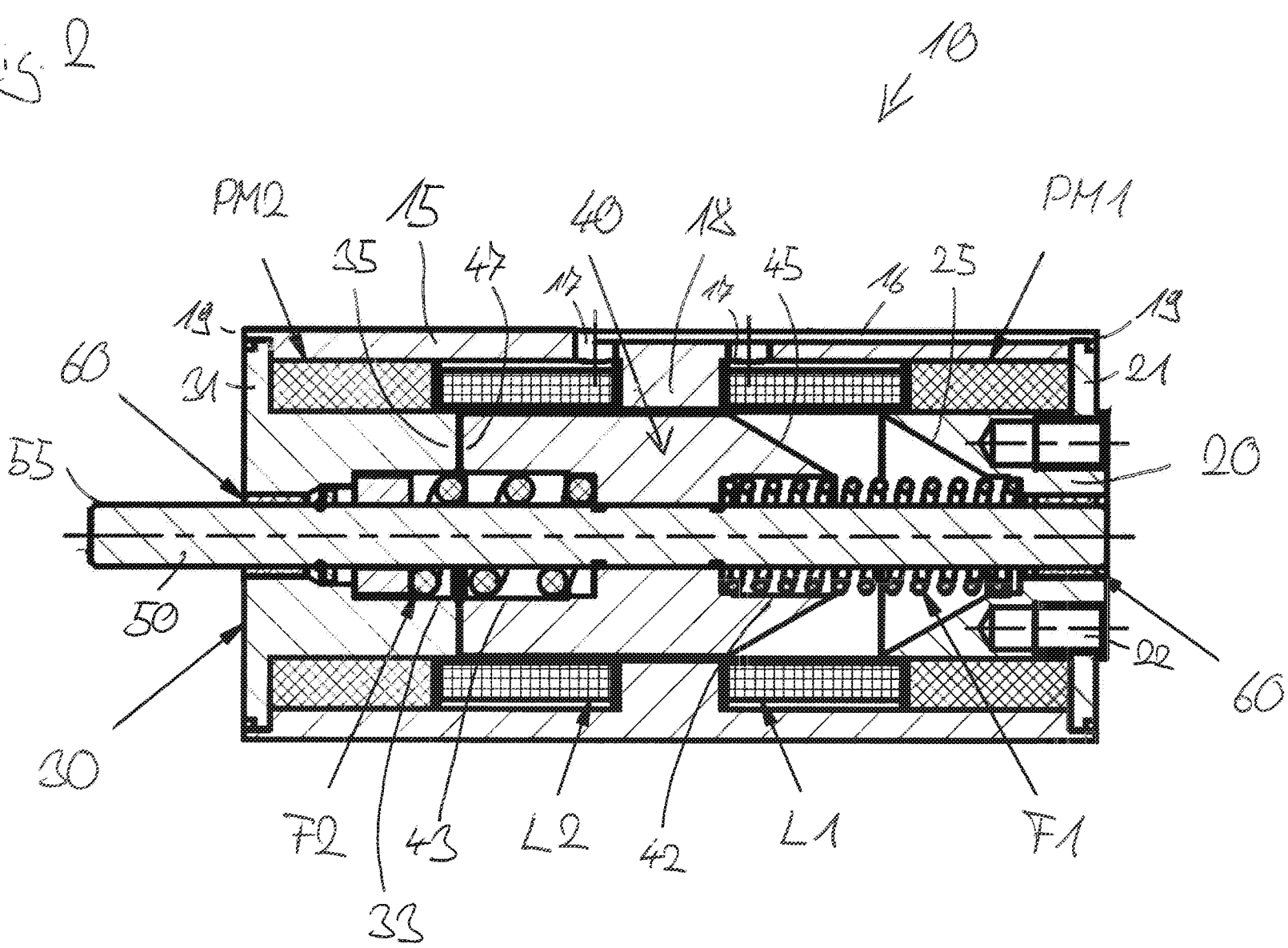
FIG. 2: the embodiment of the bistable lifting solenoid in a sectional view.

FIGS. 1 and 2 show an embodiment of a bistable lifting solenoid in which a plurality of aspects of the present invention are implemented in combination. The features in accordance with the individual aspects described in combination with reference to the embodiment can, however, also each be used per se in accordance with the invention.

The bistable lifting solenoid in accordance with the present invention has a stator and an armature 40 axially displaceable with respect to the stator. The stator and the armature consist of a soft magnetic material.

In the embodiment, the stator comprises one soft magnetic sleeve 15 and two soft magnetic front sections 20 and 30 that form a housing in which the armature 40 is displaceably arranged. The front sections in the embodiment each have a region that is arranged in the sleeve 15, in particular a substantially cylindrical region.

In the embodiment, the armature 40 is supported by an axle 50 that is axially displaceable supported via bearings 60 at the front sections 20 and 30 of the stator. The axle 50 is accordingly moved by a movement of the armature 40. In the embodiment, the axle 50 has at least one second side having a connection region 55 by which it can be connected to an element to be moved by the lifting solenoid. The working air gaps of the lifting solenoid are located between the armature 40 and the front sections 20 and 30.

The lifting solenoid is shown at the top in FIG. 1 in a second end of stroke position in which the second side of the axle 50 with the connection region 55 is fully extended and at the bottom in a first end of stroke position in which the second side of the axle 50 with the connection region 55 is completely retracted and the axle is in turn completely extended on the oppositely disposed first side.

The lifting solenoid in the embodiment has bores 22, in particular threaded bores, through which it can be assembled.

Alternative design configurations of the stator, of the armature, and of the axle are likewise conceivable within the framework of the present invention.

The design of the lifting solenoid is shown in the sectional view in FIG. 2. The bistable lifting solenoid has a spring system having a first spring F1 that in a first end of stroke position exerts a force on the armature 40 in the direction toward the center of stroke position and a second spring F2 that in the second end of stroke position shown in FIG. 2 exerts a force on the armature 40 in the direction toward the center of stroke position.

In the embodiment, the two springs are each arranged within the housing formed by the stator between one of the front sections 20 or 30 and the armature 40. In the embodiment, they are coil springs that surround the axle 50. Annular grooves 42 and 43 that take up at least a part of the respective spring in the respective end positions are provided in the armature 40. Corresponding annular grooves can also be provided in the front sections 20 and 30.

At least one permanent magnet PM1 and PM2 is furthermore provided that holds the armature 40 against the force of the respective spring in the respective end of stroke position in the currentless state of the coils. In the embodiment, two permanent magnets PM1 and PM2 are provided that are associated with the respective end of stroke positions. Instead of two permanent magnets, only one single permanent magnet could also be used.

Two coils L1 and L2 are furthermore provided and on an application of current to them, the armature can be traveled from one end of stroke position into the other end of stroke position. In the embodiment, two coils L1 and L2 are provided whose windings in the region 17 are respectively separately led out of the housing. Alternatively, the coils could also be connected in series within the housing and can preferably have a central tapping.

In accordance with the first aspect of the present invention, differing springs F1 and F2 are used. In the embodiment, the first and second springs, on the one hand, have spring travels of different lengths. The spring travel of the first spring F1 is in particular greater than the spring travel of the second spring F2. The two springs furthermore exert forces of different amounts on the armature in the respective end of stroke position. The first spring F1 in particular exerts a smaller force on the armature 40 in the first end of stroke position in which the armature 40 is in abutment with the first front section 20 than the second spring F2 does in the second end of stroke position shown in FIG. 2 in which the armature 40 is in abutment with the second front section 30. The first spring F1 in the embodiment furthermore has a smaller spring rate than the second spring F2.

Due to the smaller spring travel, the second spring furthermore only exerts a force on the armature 40 over a part of the stroke distance. A retention security, not drawn in FIG. 2, is preferably provided that secures the second spring F2 in a predefined position over the part of the stroke distance in which it does not generate any force between the armature and the stator and holds it in a preloaded state. This increases the service life of the lifting solenoid.

In the specific embodiment, the lifting solenoid has a travel distance of 15 mm. The first spring has a spring travel that corresponds to the stroke distance. The second spring F2 in contrast only has a spring travel of 2 mm. The first spring exerts a force of approximately 60 N on the armature in the first end of stroke position and has a spring rate of approximately 3.5 N/mm. The second spring exerts a force of approximately 350 N on the armature in the second end of stroke position and has a spring rate of approximately 170 N/mm. Both springs are preloaded on reaching their maximum spring travels.

A number of advantages can be achieved by the different springs F1 and F2 in the embodiment. The strong spring F2 provides a high acceleration of the armature on a movement from the second end of stroke position in the direction toward the center of stroke position. The first spring F1 having the long spring travel in contrast permits a correspondingly long design of the stroke distance.

In accordance with a further aspect of the present invention, the lifting solenoid has an asymmetrically arranged resting point in the currentless case. This resting point represents a third stable stroke position of the bistable lifting solenoid in the currentless case that is arranged between the first and second end of stroke positions. This resting point in which the opposite forces exerted on the armature 40 by the springs and permanent magnets is asymmetrical, i.e. is arranged offset with respect to the center of the stroke distance.

This has the advantage that the lifting solenoid can be brought into a largely extended or retracted position with only very little energy in that it is traveled into the resting point from the end of stroke position that is further remote from the resting point. Such an asymmetrical resting point that can be traveled to with only little energy use represents an important securing function in a number of applications.

In the embodiment, the asymmetrical resting point is mainly achieved by the different springs in accordance with the first aspect of the present invention, in particular by the spring travels of different lengths and/or the forces of different amounts and/or by the spring rates of different amounts of the first and second springs. The resting point is in particular arranged closer to the second end of stroke position than to the first end of stroke position since the second spring has a smaller spring travel than the first spring. Since the second spring has a much larger spring rate than the first spring, the resting point is predominantly determined by the length of the spring travel of the second spring and is therefore approximately 2 mm remote from the second end of stroke position in the embodiment. In the embodiment, the magnetic forces acting on the armature only exercise a subordinate role on the exact position of the resting point.

The resting point can be reached from the first end of stroke position with only little energy expenditure since the (high) returning force of the second spring F2 does not have to be overcome for this purpose. The drive is nevertheless already largely extended on reaching the resting point.

In accordance with a further aspect of the present invention, the lifting solenoid is configured such that the permanent magnetic holding force, often also called an "adhering force", is of different amounts in the first and second end of stroke positions. The lifting solenoid is in particular configured here such that the permanent magnetic holding force is smaller in the first end of stroke position than in the second end of stroke position. In the embodiment, a geometrical characteristic influence is provided for this between the first front side 45 of the armature that faces the first front section 20 and the inner side 25 of the first front section 20. The first working air gap that is closed in the first end of stroke position is located between these two surfaces 25 and 45. The geometrical characteristic influence means that the surfaces 25 and 45 do not extend in a plane perpendicular to the axial direction of movement of the lifting solenoid, but rather have a profile with respect to such a plane. In the embodiment, the surfaces have a conical profile that has an angle in the embodiment such that the permanent magnetic holding force is reduced by approximately 50%.

No geometrical characteristic influence is in contrast provided on the oppositely disposed side on which the second front side 47 of the armature 40 and the inner side 35 of the second front section 30 are oppositely disposed over a second working air gap. Here, the two surfaces between which the working air gap is located extend in a plane perpendicular to the axial direction of movement of the lifting solenoid.

The permanent magnetic holding forces of different amounts in the first and second end of stroke positions are preferably selected such that the respective difference between the permanent magnetic holding force and the respective opposite spring force is substantially equal in the two end of stroke positions and/or is preferably at least in the same order of magnitude while taking account of the external forces acting on the lifting solenoid. This difference respectively secures the lifting solenoid in the two end of stroke positions against an unwanted release, for example due to vibrations. In the embodiment, the magnetic holding force in the first end of stroke position amounts to approximately 225 N; in the second end of stroke position to approximately 450 N.

In accordance with a further aspect of the present invention, the bistable lifting solenoid is adapted such that the value of the respective potential energy stored in the lifting solenoid in the two end of stroke positions does not differ by more than 50% of the greater value from one another, i.e. such that the smaller of the two values amounts to at least 50% of the greater value. The potential energy in the two end of stroke positions is preferably here substantially the same. The electrical energy is left out of consideration for the calculation of the potential energy and the currentless case is looked at. In the simplest case, the potential energy therefore results from the potential energy stored by the springs and the permanent magnets.

External forces that act on the bistable lifting solenoid within the framework of its specific use are particularly preferably also taken into account with the framework of the determination of the potential energy. This can, for example, be the force of gravity if the lifting solenoid lifts an element against the force of gravity. Alternatively or additionally, it can be a case of external spring forces, for example when the lifting solenoid is used to move a spring-loaded element.

A particularly energy saving operation of the lifting solenoid results from the similar amount of potential energy in the two end of stroke positions. In the embodiment, the similar amount of potential energy is in particular achieved in that the spring having the greater force and/or spring rate has the smaller spring travel.

In the embodiment of the bistable lifting solenoid shown in FIGS. 1 and 2, a second aspect of the present invention is furthermore implemented that is independent of the above aspects and in particular independent of the different embodiment of the springs, and indeed through the design embodiment of the stator and of the armature, and through the arrangement of the permanent magnets and of the coils.

The stator in the embodiment is formed by a soft magnetic sleeve 15 and by the two front sections 20 and 30 that together form a housing in whose interior the soft magnetic armature 40 is displaceably arranged. The sleeve 15 extends between the first front section 20 and the second front section 30 over the total length of the lifting solenoid. A first working air gap is formed between the first side of the armature 40 and the first front distance 20 and a second working air gap is formed between the second side of the armature 40 and the second front section 30.

In accordance with the second aspect, two permanent magnets PM1 and PM2 are provided that hold the armature 40 in the respective end of stroke positions against the force of the spring system. The two permanent magnets PM1 and PM2 are each arranged between the magnetic sleeve 15 and the respective front section 20 and 30 respectively such that they put them under a magnetic voltage. For this purpose, PM1 and PM2 can, for example, be formed from a respective one or more radially polarized hard magnetic rings, preferably NdFeB. Alternatively, PM1 and PM2 can be formed from radially or diametrically polarized hard magnetic ring segments. The armature 40 in the respective end of stroke position magnetically short circuits the sleeve 15 with the respective front section 20 or 30 respectively by the magnetic circuit section 18 that acts as a back iron so that the respective permanent magnet exerts a holding force on the armature 40 in the respective end of stroke position. The two end of stroke positions have respective coils L1 and L2 associated with them on an application of current to which the armature is released from the respective end of stroke position or, with a reverse current direction, can be pulled into its end of stroke position against the force of the respective spring.

The magnetic part circuit formed in the first or second end of stroke positions by the sleeve, the armature, the respective front section, and respective permanent magnets surrounds the respective coils L1 and L2 such that a current application to the coil in one current direction acts against the magnetic holding force of the respective permanent magnet and thus provides a deflection of the armature from the respective end of stroke position. Once the holding force of the permanent magnet has been overcome, the respective spring substantially contributes to the movement of the armature.

The coils L1 and L2 are arranged in the axial direction of the lifting solenoids between the two permanent magnets PM1 and PM2. The sleeve 15 has a middle magnetic circuit section 18 that is arranged between the two coils L1 and L2 such that it magnetically couples to the armature 40 both in the first end of stroke position and in the second end of stroke position. In the axial direction, the respective coils L1 and L2 adjoin this magnetic circuit section 18 of the sleeve 15 at both sides and the respective permanent magnets PM1 and PM2 are then arranged further outwardly in the axial direction next to said coils L1 and L2 respectively. The magnetic circuit section 18 in the embodiment is formed by an inwardly projecting elevated portion of the inner wall of the sleeve 15, while the coils L1 and L2 or the permanent magnets F1 and F2 are arranged in grooves or cutouts at the inner periphery of the sleeve 15.

In the embodiment, the permanent magnets PM1 and PM2 are each arranged between the sleeve 15 and a part of the respective front section 20 or 30 respectively projecting into the sleeve. The coils L1 and L2 are in contrast at least partly arranged next to the movement region of the armature 40.

The construction length of the lifting solenoid can be reduced over other construction designs by the use of the axially outwardly arranged permanent magnets PM1 and PM2.

In the embodiment, the lifting solenoid is configured rotationally symmetrically about the axle 50.

In accordance with a further aspect of the present invention, the soft magnetic front sections 20 and 30 of the stator each have a fastening region 21 or 31 respectively by which they are connected to the sleeve 15. This has substantial advantages from a construction aspect since a simple and stable connection is hereby made possible between the front sections and the sleeve in the connection region 19.

Since the fastening region 21 or 31 respectively, however, extends in the radial direction over the first or second permanent magnets PM1 or PM2 respectively, it establishes an actually unwanted magnetic short circuit between the sleeve and the respective front section. The fastening region is therefore preferably configured such that it is magnetically completely saturated by the respective permanent magnet. The magnetic flux that flows from the sleeve over the fastening section preferably amounts to a maximum of 50% of the magnetic flux that flows in the respective end of stroke position from the sleeve over the armature to the respective front section, preferably a maximum of 20%.

The fastening region 21 or 31 respectively is board-shaped, in particular ring board-shaped. The fastening region can furthermore have cutouts to reduce the soft magnetic material in the region of the fastening region. In a possible embodiment, the fastening region 31 can have less material toward the outside, for example in that it is thinner toward the outside to thus effect a saturation that is as uniform as possible in this region.

The first and second aspects are implemented in combination in the embodiment, i.e. the lifting solenoid has a design setup in accordance with the second aspect and different springs in accordance with the first aspect. The other above-described aspects are also implemented in combination.

Every single one of the above-described aspects of a lifting solenoid in accordance with the present invention can, however, also be implemented independently of the other aspects. The features described with respect to the individual aspects therefore form the present invention in each case also independently of the features described with respect to other aspects. Only some of the aspects can furthermore also be combined with one another, with the present invention comprising all the combinations of the above-described aspects.

The design setup in accordance with the second aspect can in particular also be used with identical springs and/or with identical magnetic holding forces.

The embodiment with different springs and/or different magnetic holding forces and/or with an asymmetrical resting point can furthermore also be used in a different design embodiment of the holding magnet.

For example, instead of the two outwardly disposed permanent magnets PM1 and PM2, a single permanent magnet can be used that is arranged in the region of the magnetic circuit section 18 and that puts the sleeve 15 and the armature 40 under a magnetic voltage in both end of stroke positions.

Different design embodiments of the stator are furthermore also conceivable, for example with two separate soft magnetic sections between which at least parts of the armature are arranged, for example in the form of an armature plate. Further alternatively or additionally, embodiments are also conceivable having outwardly disposed armature plates and/or having permanent magnets arranged at the armature.

Figure 3:
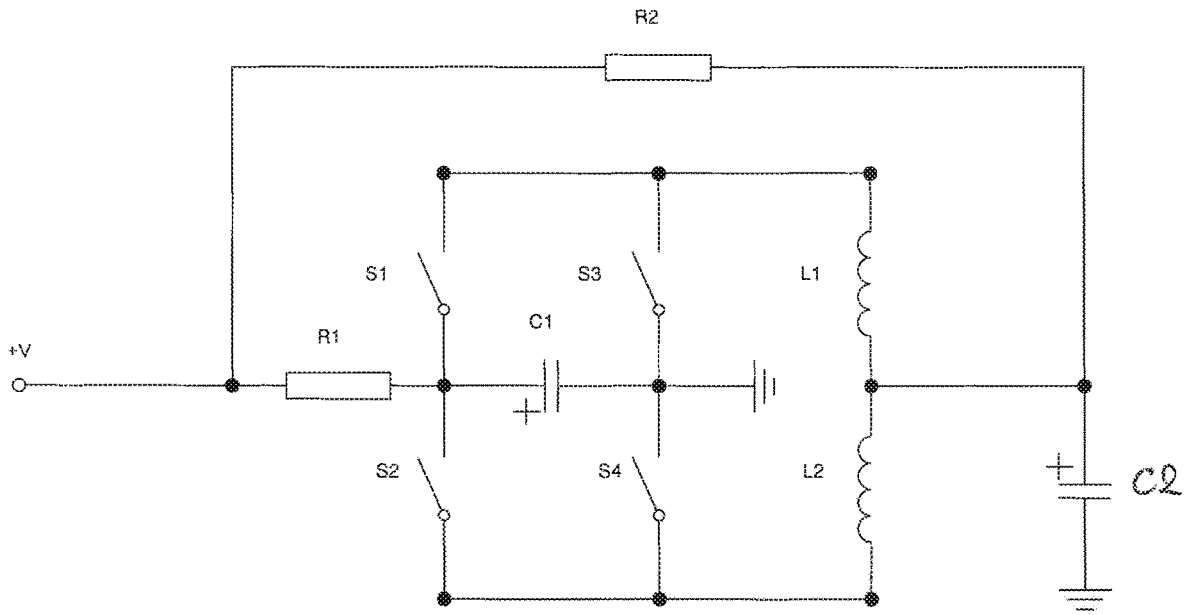
FIG. 3: a first embodiment of a control in accordance with the invention in accordance with the third aspect for the control of a bistable lifting solenoid.
Figure 4:
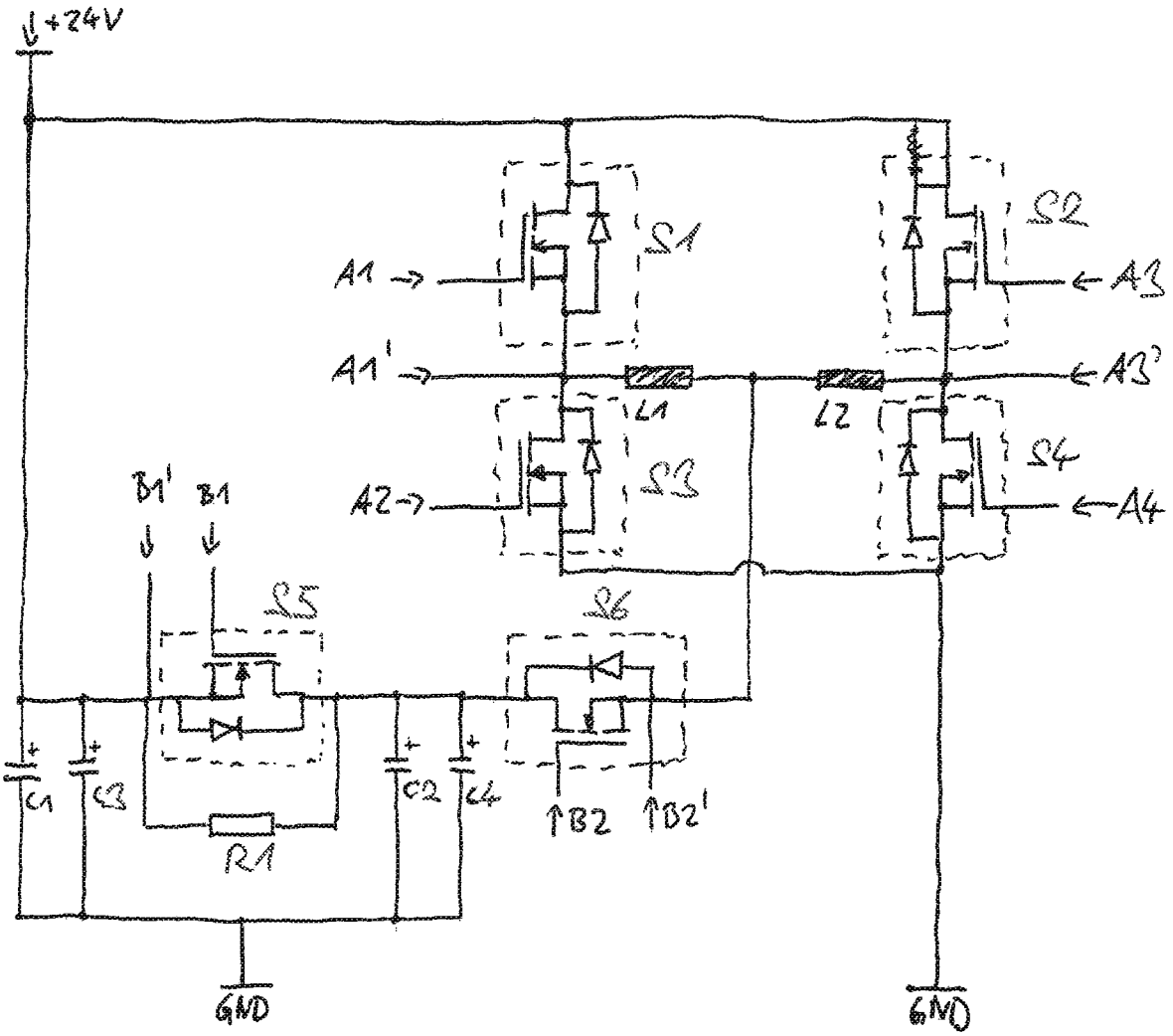
FIG. 4: a second embodiment of a control in accordance with the invention in accordance with the third aspect for the control of a bistable lifting solenoid.

Possible embodiments of a control to control a bistable lifting solenoid within the framework of the present invention are shown in FIGS. 3 and 4. They can thus be used to control bistable lifting solenoids of any desired kind that have at least two coils L1 and L2. The control is particularly preferably used with bistable lifting solenoids in which the armature is permanently magnetically held in the first and second stroke positions in the currentless case, with the lifting solenoid being released from the first end of stroke position on an application of current to the first coil L1 and/or to the second coil L2 with a first current direction and being released from the second end of stroke position on an application of current to the second coil L2 and/or to the first coil L1 with a second current direction.

The lifting solenoid particularly preferably has a spring system having a first spring and a second spring, wherein the first spring exerts a force on the armature in the direction toward the center of stroke position in the first end of stroke position, and wherein the second spring exerts a force on the armature in the direction toward the center of stroke position in the second end of stroke position. The lifting solenoid can be pulled against the spring force of the first spring into the first end of stroke position by application of current to at least the first coil L1 with a second current direction and the armature can be pulled into the second end of stroke position by application of current to at least the second coil L2 with a second current direction.

The stator and the armature can form a magnetic part circuit in the respective end of stroke position, which magnetic part circuit surrounds the respective coil L1 or L2 respectively such that an application of current to the respective coil with the first current direction weakens the permanent magnetic holding force.

The controls can particularly preferably be used to control a lifting solenoid in accordance with the invention such as was described above and particularly preferably to control a lifting solenoid in which one or more of the above-described aspects are implemented. The above-described lifting solenoids in accordance with the present invention further preferably work such as has just been described.

It is common to both embodiments of the control that the application of current to the coils L1 and L2 takes place by one or more energy stores C1, C2 that are discharged via switches S1 to S4 by the coils L1 and L2. The energy stores are capacitors, in particular electrolytic capacitors, in the embodiment. For this purpose, a full bridge formed by the switches S1 to S4 is used in the embodiment to be able to freely select the direction in which the discharge by the coils takes place.

It is further common to both embodiments that at least one first energy store C1 can be discharged by coils L1 and L2 connected in series. At least one second energy store C2 can in contrast be discharged by only one of the two coils L1 or L2. For this purpose, the second energy store C2 can be connected to the central tapping between the two coils L1 and L2. By which of the two coils L1 or L2 the respective discharge takes place is determined by the full bridge that is used both to control the discharge direction of the first energy store C1 and to control the discharge of the second energy store C2 by the first coil L1 or by the second coil L2.

In the embodiment shown in FIG. 3, the energy store C2 is in constant contact with the central tapping between the two coils. If the discharge is therefore released by the full bridge, the first energy store is discharged in series by the two coils L1 and L2 and the second energy store C2 is simultaneously discharged by one of the two coils L1 or L2.

In the embodiment shown in FIG. 4, the second energy store C2 is in contrast connected in a switchable manner to the central tapping between the two coils L1 and L2, and indeed via the switch S6. The second energy store C2 can in contrast be connected in parallel to the first energy store C1 via a further switch S5.

The circuit in FIG. 4 can discharge both energy stores C1 and C2 in series via the two coils L1 and L2 in a first operating mode. In a second operating mode, in contrast, only the first energy store is discharged in series via the coils L1 and L2 and the second energy store C2 is in contrast discharged via one each of the two coils L1 or L2. In the second operating mode, the second energy store C2 is preferably connected to the full bridge with a time delay, i.e. the second energy store C2 is only connected to the central tapping between the two coils after the full bridge has already established a connection between the first energy store and the two coils and has closed the circuit for the discharge of C1. The second energy store C2 is, however, preferably connected at so early a time that the adjustment movement has not yet started.

The discharge of the second energy store C2 by the central tapping has the result that it is only discharged by one of the two coils L1 or L2. On the one hand, more energy is hereby available for this coil. It results as a further advantage that the current through the other coil is limited and an overcompensation is hereby avoided.

The circuit is preferably configured such that the first operating mode is used to move the lifting solenoid in a first direction and the second operating mode is used to move the lifting solenoid in a second direction. The first operating mode, in which the two energy stores C1 and C2 are connected in parallel and both are discharged by the coils L1 and L2 connected in series, can in particular be used for a movement from the first end of stroke position into the second end of stroke position. In contrast, the second operating mode in which the second energy store C2 is discharged in parallel with the energy store C1 by one of the two coils L1 and L2, preferably with a time delay with respect to the discharge of the first energy store C1 is preferably used for a movement from the second end of stroke position into the first end of stroke position. Such a different control of the two directions of movement is in particular of advantage when the lifting solenoid has an asymmetrical characteristic and/or different springs.

The switches of the full bridge and the switches for switching over between the first and the second operating modes are preferably each configured as semiconductor switches, in particular in the form of a MOSFET.

This is shown in FIG. 4. For the control, respective control inputs A1 to A4 and B1 and B2 are provided via which a voltage difference with respect to the reference connectors A1', A3', B1', and B2' is applied to control the respective switch.

A respective two first energy stores C1 and C3 and two second energy stores C2 and C4 are furthermore connected in parallel in the embodiment in FIG. 4.

In the embodiment shown in FIG. 3, the charging of the energy stores C1 and C2 takes place via resistors R1 and R2 by which they are connected to a voltage supply +V. If the voltage supply is therefore switched on, the energy stores charge via the respective resistors.

However, an electronically regulated charge of the energy stores, in particular with a constant charging current, is preferably carried out both in the first embodiment and in the second embodiment.

Alternatively or additionally, the charge current by which the energy stores are charged can be adjustable. The control can, for example, have a plurality of operating modes that differ by the amount of the charge current, with the control preferably being switchable between the operating modes. The required dead time between two adjustment processes is substantially determined by the charge current. At a high charge current, the time required between two adjustment processes is shortened. A low charge current in contrast extends this time. Due to the different operating modes, the lifting solenoid can, for example when longer times between two adjustment processes are permitted, be operated with an energy supply having a smaller power without overloading it.

Different charge currents can, for example, be implemented by different resistors or by a corresponding electronic control, preferably by switch regulators, for example step-up converters or step-down converters.

The lifting solenoid in accordance with a further aspect of the present invention is also controlled independently of the specific embodiment of the control such as was described above such that, on a switching off of the voltage supply, the lifting solenoid is moved from the first end of stroke position into the second end of stroke position. On a connection of the supply voltage, the lifting solenoid is in contrast moved back from the second end of stroke position into the first end of stroke position.

A monitoring of the supply voltage is preferably carried out. A drop of the supply voltage can, for example, be recognized by means of a flank recognition. If the supply voltage drops, the energy stores are discharged via the coil or coils of the lifting solenoid to move the lifting solenoid from the first end of stroke position into the second end of stroke position.

The electrical energy stores are preferably first charged after the switching on of the supply voltage, with the control recognizing the reaching of a specific threshold voltage at the energy store and thereupon discharging the energy store via the coil or coils of the lifting solenoid so that the latter moves from the second end of stroke position into the first end of stroke position.

Such an embodiment has the advantage that the lifting solenoid in accordance with the invention can be used without problem for a replacement of monostable lifting solenoids and/or monostable pneumatic valves and/or monostable pneumatic drives.

If, as described above, the lifting solenoid has a resting point offset with respect to the center of stroke position, such an operation becomes particularly reliable. For even when the supply voltage fails in an unwanted manner directly after a switching process by which the lifting solenoid was traveled into the first end of stroke position or when other problems with the energy stores occur, a traveling into the resting point is still possible since only very little energy is required for this purpose. However, the lifting solenoid has already largely traveled toward the second end of stroke position at this resting point.

The safety in the use of energy stores, in particular capacitors, for the switching of the lifting solenoid is hereby substantially increased.

The invention claimed is:

1. A bistable lifting solenoid that has a first end of stroke position and a second end of stroke position and a center of stroke position disposed between the end of stroke positions, comprising:

a stator;

one or more armatures;

at least one coil;

at least one permanent magnet; and a spring system having a first spring that exerts a force on the armature or armatures in a direction toward the center of stroke position in the first end of stroke position and having a second spring that exerts a force on the armature or armatures in a direction toward the center of stroke position in the second end of stroke position, wherein the armature or armatures are held in a permanent magnetic manner against the spring force in both end of stroke positions in a currentless case, wherein the first and second springs have spring travels of different lengths and/or exert forces of different strengths on the armature or armatures and/or have spring rates of different amounts in the respective end of stroke position.

2. The bistable lifting solenoid in accordance with claim 1, wherein the spring travel of the first spring is greater than the spring travel of the second spring and the second spring exerts a greater force on the armature or armatures in the second end of stroke position than the first spring exerts on the armature or armatures in the first end of stroke position;

and/or wherein the spring travel of the first spring is greater than the spring travel of the second spring and the spring rate of the second spring in the second end of stroke position is greater than the spring rate of the first spring in the first end of stroke position;

and/or wherein the spring travel of the first spring amounts to between twice and 100 times the spring travel of the second spring;

and/or wherein the force the second spring exerts on the armature or armatures in the second end of stroke position amounts to between 1.5 times and 100 times the force the first spring exerts on the armature or armatures in the first end of stroke position;

and/or wherein the spring rate of the second spring in the second end of stroke position amounts to between twice and 1000 times the spring rate of the first spring in the first end of stroke position.

3. The bistable lifting solenoid in accordance with claim 1, wherein at least one of the springs does not generate any force between the armature and the stator over a part of a stroke distance and/or is not in contact with the armature and/or the stator, with a retention security being provided that secures the spring in a predefined position over this part of the stroke distance and in so doing holds it in a preloaded state.

4. The bistable lifting solenoid in accordance with claim 1, wherein the bistable lifting solenoid has an asymmetrical characteristic;

and/or wherein a magnetic holding force of the lifting solenoids is smaller in one of the two end of stroke positions than in the other end of stroke position, with the magnetic holding force in the first end of stroke position being smaller than in the second end of stroke position; and/or wherein the magnetic holding force of the lifting solenoid in one of the two end of stroke positions is at least 20% smaller than in the other end of stroke position; and/or wherein the magnetic holding force in one of the end of stroke positions amounts to at least 20% of the magnetic holding force in the other end of stroke position;

and/or wherein the stator and the armature or armatures have a geometrical characteristic influence in one of the end of stroke positions, and in the first end of stroke position, having a conically extending working air gap, not extending in a plane perpendicular to the axle of the lifting solenoid, with the stator and the armature or armatures in the other end of stroke position, and in the second end of stroke position, having a weaker or no geometrical characteristic influence, and/or wherein the difference between the amount of the magnetic holding force and the amount of the force that the respective spring applies differs by a maximum of 50% of the larger value in both end of stroke positions.

5. The bistable lifting solenoid in accordance with claim 1, wherein the lifting solenoid has a resting point in a position between the two end of stroke positions in the currentless case, with the resting point being reached by an asymmetrical characteristic; and/or wherein the resting point is offset with respect to the center of the stroke distance, with the resting point being arranged between the second end of stroke position and the center of the stroke distance; and/or wherein the distance between the resting point and the center of the stroke distance amounts to more than 5% of the stroke distance; and/or wherein the distance between the resting point and the second end of stroke position amounts to more than 2% of the stroke distance.

6. The bistable lifting solenoid in accordance with claim 1, wherein potential energy, excluding electrical energy and in the currentless case, stored in the lifting solenoid in each of the two end of stroke positions does not differ by more than 50% of a greater value.

7. The bistable lifting solenoid in accordance with claim 1, wherein the at least one coil and the at least permanent magnet are arranged at the stator; and/or wherein the stator forms a housing that surrounds the armature or armatures, with one armature being provided that is arranged in an interior of the stator on a guide rod, with the guide rod being movably supported on the stator;

and/or wherein the spring system is arranged within the stator, with the first spring being arranged between a first front section and a first side of the armature and the second spring being arranged between a second front section and a second side of the armature, and/or with the first and second springs being configured as coil springs that encompass the guide rod of the armature.

8. The bistable lifting solenoid in accordance with claim 1, wherein the stator has a soft magnetic sleeve and first and second soft magnetic front sections that form a housing in which the armature is displaceably arranged;

wherein at least one first working air gap is provided between the armature and the first front section and at least one second working air gap is provided between the armature and the second front section;

wherein at least one permanent magnet and at least one first coil and one second coil are arranged at the stator;

wherein the armature forms a first magnetic part circuit with the sleeve and the first front section in the first end of stroke position, said first magnetic part circuit at least surrounding the first coil, while the working air gap or gaps is/are opened to a maximum with the second front section;

and wherein the armature forms a second magnetic part circuit with the sleeve and the second front section in the second end of stroke position, said second magnetic part circuit at least surrounding the second coil, while the working air gap or gaps is/are opened to a maximum with the first front section, wherein the at least one permanent magnet is arranged between the first and second coils in an axial direction and forms a respective part of the first and second magnetic part circuits, with the permanent magnet being arranged such that it overlaps the armature both in the first end of stroke position and in the second end of stroke position in the axial direction and surrounds it, with the permanent magnet being directly magnetically coupled to the armature.

9. A bistable lifting solenoid, that has a first end of stroke position and a second end of stroke position and a center of stroke position disposed between the end of stroke positions, comprising:

a stator;

one or more armatures;

at least one coil;

and at least one permanent magnet, with the armature or armatures being held in a permanent magnetic manner against a spring force in both end of stroke positions in the currentless case;

wherein the stator has a soft magnetic sleeve and first and second soft magnetic front sections that form a housing in which the armature is displaceably arranged;

wherein at least one first working air gap is provided between the armature and the first front section and at least one second working air gap is provided between the armature and the second front section;

wherein at least one permanent magnet and at least one first coil and one second coil are arranged at the stator;

wherein the armature forms a first magnetic part circuit with the sleeve and the first front section in the first end of stroke position, said first magnetic part circuit at least surrounding the first coil, while the working air gap or gaps is/are opened to a maximum with the second front section;

and wherein the armature forms a second magnetic part circuit with the sleeve and the second front section in the second end of stroke position, said second magnetic part circuit at least surrounding the second coil, while the working air gap or gaps is/are opened to a maximum with the first front section, wherein at least one first permanent magnet and one second permanent magnet are provided, with the first and second coils being arranged in an axial direction between the first and second permanent magnets, with the first permanent magnet putting the sleeve and the first front section under a magnetic voltage and the second permanent magnet putting the sleeve and the second front section under a magnetic voltage.

10. The bistable lifting solenoid in accordance with claim 9, wherein the first part magnetic circuit encompasses the first permanent magnet and the second part magnetic circuit encompasses the second permanent magnet;

and/or wherein the armature magnetically short circuits the sleeve and the first front section in the first end of stroke position and that the armature magnetically short circuits the sleeve and the second front section in the second end of stroke position;

and/or wherein the sleeve has a magnetic circuit section between the two coils that overlaps the armature in both the first end of stroke position and in the second end of stroke position in the axial direction and that surrounds it, with the magnetic circuit section magnetically directly coupling at the armature, and/or wherein the first and second coils are arranged at least partly between the sleeve and a movement range of the armature and/or in an inner groove and/or cutout of the sleeve, and/or having a spring system having a first spring that exerts a force on the armature or armatures in the direction toward the center of stroke position in the first end of stroke position and having a second spring that externs a force on the armature or armatures in the direction toward the center of stroke position in the second end of stroke position, wherein the armature or armatures are held in a permanent magnetic manner against the spring force in both end of stroke positions in the currentless case.

11. The bistable lifting solenoid in accordance with claim 9, wherein the first and/or second front section has/have a fastening region that extends beyond the first or second permanent magnet in a radial direction and is fastened to the sleeve, with the fastening region being magnetically saturated by the first or second permanent magnet; and/or wherein the fastening region is ring board-shaped; and/or wherein the fastening region has cutouts and/or has less material toward the outside and becomes thinner.

12. The bistable lifting solenoid in accordance with claim 1, having a control with one or more electrical energy stores, and having an electrical circuit that discharges the energy store or energy stores via the at least one coil of the lifting solenoid with the aid of switches, such that the lifting solenoid is moved from one end of stroke position into the other end of stroke position, with the control recognizing an interruption and/or a switching off of a voltage supply and in response hereto moving the lifting solenoid from the first end of stroke position into the second end of stroke position;

and/or wherein the control is configured such that in response to a switching on of the supply voltage, the electrical energy store or stores is/are charged and such that the reaching of a specific threshold voltage at the electrical store is recognized by the control, whereupon the latter discharges the energy store or stores via the bistable lifting solenoid so that it moves in the opposite direction.

13. The bistable lifting solenoid in accordance with claim 12, wherein the bistable lifting solenoid is controlled via a full bridge, with the circuit having two further switches via which a first energy store and a second energy store are switchable in parallel in a first switching stage and are separately dischargable in a second switching stage; and/or having means for a position detection of a stopper.

14. The bistable lifting solenoid in accordance with claim 1, having a control with at least one first energy store and one second energy store, wherein the first energy store is dischargable in series by two coils of the lifting solenoid; and wherein the second energy store is dischargable by one of the two coils of the lifting solenoid, with the second energy store being selectively dischargeable by one of the two coils and/or selectively also in series by two coils of the lifting solenoid, with the electrical circuit being configured such that for the control of a first direction of movement of the lifting solenoid from the first end of stroke position into the second end of stroke position both energy stores are discharged in series by the two coils of the lifting solenoid, and for the control of a second direction of movement of the lifting solenoid from the second end of stroke position into the first end of stroke position the first energy store is discharged in series by the coils and the second energy store is discharged by only one of the two coils, with the discharge of the second energy store taking place with a time delay from the discharge of the first energy store, with the discharge of the second energy store starting even before the occurrence of the adjustment process; and/or having two coils that are connected in series and have a central tapping, with at least one first energy store and one second energy store being provided, with both energy stores being discharged by the coils connected in series along a first direction of movement, while on the opposite direction of movement, the first energy store first is discharged by the coils connected in series and the second energy store is discharged with a time delay via the central tapping of both coils, with the discharge of the second energy store starting even before the occurrence of the adjustment process.

15. A controller for a bistable lifting solenoid, the bistable lifting solenoid having a first end of stroke position and a second end of stroke position and a center of stroke position disposed between the end of stroke positions, the bistable lifting solenoid comprising at least two coils, the controller comprising:

at least one first energy store and one second energy store, wherein the first energy store is dischargable in series by the two coils of the lifting solenoid; and wherein the second energy store is selectively dischargeable by one of the two coils and in series by the two coils of the lifting solenoid, with the controller being configured such that for the control of a first direction of movement of the lifting solenoid from the first end of stroke position into the second end of stroke position, both energy stores are discharged in series by the two coils of the lifting solenoid, and for the control of a second direction of movement of the lifting solenoid from the second end of stroke position into the first end of stroke position, the first energy store is discharged in series by the coils and the second energy store is discharged by only one of the two coils.

16. The bistable lifting solenoid in accordance with claim 2, wherein the spring travel of the first spring amounts to between 4 times and 20 times the spring travel of the second spring; and/or wherein the force the second spring exerts on the armature or armatures in the second end of stroke position amounts to between 3 times and 15 times the force the first spring exerts on the armature or armatures in the first end of stroke position; and/or wherein the spring rate of the second spring in the second end of stroke position amounts to between 20 times and 100 times the spring rate of the first spring in the first end of stroke position.

17. The bistable lifting solenoid in accordance with claim 3, wherein the second spring does not generate any force between the armature and the stator over the part of the stroke distance and/or is not in contact with the armature and/or the stator.

18. The bistable lifting solenoid in accordance with claim 12, wherein the one or more electrical energy stores are capacitors; wherein the switches are semiconductor switches; wherein a drop in the supply voltage is recognized by means of a flank recognition; and wherein when the bistable lifting solenoid moves in the opposite direction, it moves into the first end of stroke position.

19. The bistable lifting solenoid according to claim 14, wherein the first direction of movement is along a direction of movement from the first end of stroke position into the second end of stroke position, and wherein the opposite direction of movement is a movement from the second end of stroke position into the first end of stroke position.

20. The bistable lifting solenoid according to claim 13, wherein the stopper has a microcontroller that is connected to the means for position detection and takes into account the location information acquired by means of the means for position detection on the control of the bistable lifting solenoid.

* * * * *